US006480298B1

(12) United States Patent
Sullivan

(10) Patent No.: US 6,480,298 B1
(45) Date of Patent: Nov. 12, 2002

(54) IMAGE BEARING SUBSTRATE HAVING INCREASED DENSITY AND METHOD OF FORMING SAME

(75) Inventor: William Sullivan, Rochester, NY (US)

(73) Assignee: Technology Innovations LLC, W. Henrietta, NY (US)

( * ) Notice: Subject to any disclaimer, the term of this patent is extended or adjusted under 35 U.S.C. 154(b) by 0 days.

(21) Appl. No.: 09/501,695

(22) Filed: Feb. 10, 2000

Related U.S. Application Data

(63) Continuation of application No. PCT/US99/21762, filed on Sep. 22, 1999

(60) Provisional application No. 60/101,607, filed on Sep. 24, 1998.

(51) Int. Cl.[7] ..... B41B 1/00

(52) U.S. Cl. ..... 358/1.18; 399/38; 399/408; 412/1; 412/9

(58) Field of Search ..... 399/38, 70, 408, 399/67–69; 412/1, 9, 22, 29; 358/1.18, 1.2

(56) References Cited

U.S. PATENT DOCUMENTS

| | | | | |
|---|---|---|---|---|
| 3,556,934 A | | 1/1971 | Meyer | |
| 3,779,951 A | | 12/1973 | Streu | |
| 3,884,685 A | | 5/1975 | Green, Jr. et al. | |
| 5,125,996 A | | 6/1992 | Campbell et al. | |
| 5,222,282 A | * | 6/1993 | Sukonnik et al. | 29/17.9 |
| 5,226,989 A | * | 7/1993 | Sukonnik et al. | 148/670 |
| 5,854,957 A | * | 12/1998 | Morikawa | 399/38 |
| 6,100,804 A | * | 12/1998 | Brady et al. | 340/51 |
| 5,887,408 A | * | 3/1999 | Wagner et al. | 53/411 |
| 5,940,188 A | * | 8/1999 | Kurozasa | 358/436 |
| 5,967,032 A | * | 10/1999 | Bravenec et al. | 101/211 |
| 6,054,170 A | * | 4/2000 | Chess et al. | 427/7 |
| 6,064,838 A | * | 5/2000 | Maruta et al. | 399/79 |

FOREIGN PATENT DOCUMENTS

| | | | |
|---|---|---|---|
| WO | WO 00/17448 | * | 3/2000 |

* cited by examiner

*Primary Examiner*—A. L. Wellington
*Assistant Examiner*—Monica S. Carter
(74) *Attorney, Agent, or Firm*—Brian B. Shaw, Esq.; Stephen B. Salai Esq.; Harter, Secret & Emery LLP

(57) ABSTRACT

A compressible substrate such as paper has an image formed on the substrate. The imaged substrate is subjected to a compressive force throughout the entire area of the substrate to reduce the thickness of the substrate. The substrate remains in the reduced thickness, increased density state upon release of the compressive force.

10 Claims, 1 Drawing Sheet

IMAGE BEARING SUBSTRATE HAVING INCREASED DENSITY AND METHOD OF FORMING SAME

The present application claims priority to PCT/US99/21762 filed Sep. 22, 1999, which in turn claims priority to U.S. provisional application Ser. No. 60/101,607 filed Sep. 24, 1998.

FIELD OF THE INVENTION

The present invention relates to a method and an apparatus for decreasing the volume of paper after it has been through an image transferring process.

BACKGROUND OF THE INVENTION

Books and other bound paper items are a substantial part of many businesses, homes and institutions of learning. These printed materials are generally formed of multiple sheets or layers of paper. Although each sheet may not have a great individual thickness, the cumulative total of these pages requires significant linear shelf space.

Many facilities for retaining these publications have a fixed storage volume. Thus, many materials are either sent off site or destroyed. The destruction of materials presents numerous negative implications. However, even off site storage requires cataloging transport and maintenance of the materials, thereby adding to the overall cost.

While publishers of books and other bound paper items recognize the shelf space problem, the publishers are limited to the thickness of paper they can employ. Most printing devices require the paper to have a minimum thickness, resistance to curl and other parameters that permit rapid processing of the paper. Therefore, the paper must have a certain thickness to print and the resulting publication has a corresponding thickness. This results in increased shelf space requirements of the publications. In addition, binding costs go up when the volume of material to be bound goes up.

One solution to this problem is to use thinner paper. However, thinner paper often jams in copiers and other image transfer machines.

In the 1970s, the Xerox Corporation introduced a paper known as micro-spheres that was made up of paper or plastic miniature spheres for the purpose of reducing the overall weight of the paper for reduction in mailing costs. This paper had the normal thickness of copier paper and worked well in copiers and printers without jamming, and further had the benefit of reduced mailing costs by virtue of its light weight. This paper is no longer used or manufactured today, but the technology exists for making it.

Therefore, the need exists for a method of forming an imaged paper, wherein the imaged paper has a reduced thickness.

SUMMARY OF THE INVENTION

The present invention relates to a method of increasing the density and decreasing the thickness of a substrate after it acquires an image. The image may be acquired by any of a variety of mechanisms such as a printer. The imaged substrate is then subjected to a sufficient compressive force to decrease the thickness of the substrate without altering the image.

The present invention also includes two specific embodiments of apparatuses to accomplish this compression. One embodiment is an comprises a pressure roller for contacting the imaged substrate. Alternatively, a stack of imaged substrates may be subjected to the compressive force.

DETAILED DESCRIPTION OF THE PREFERRED EMBODIMENT

Figure 1:
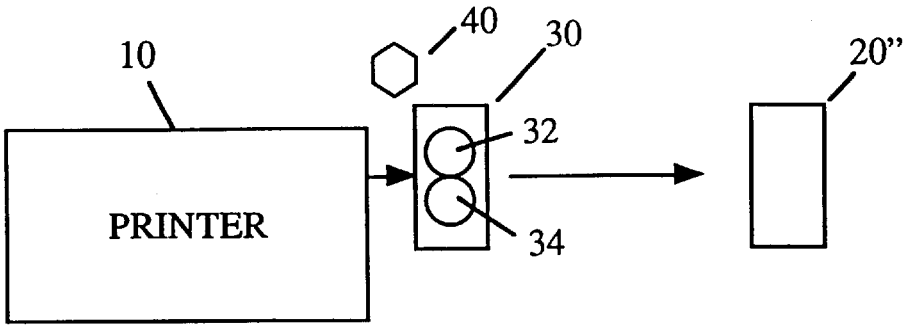
FIG. 1 is a schematic view of an apparatus for reducing the thickness of a substrate.
Figure 2:
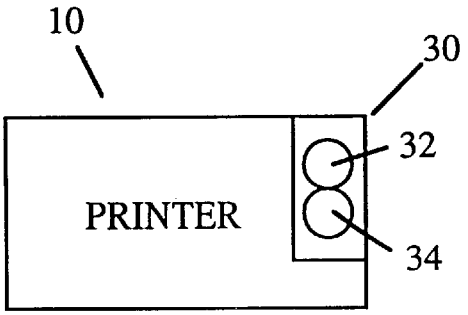
FIG. 2 a schematic view of an alternative apparatus for reducing the thickness of a substrate cross-sectional view of a sheet of collapsible paper.

Referring to FIG. 1, the present invention may operate in conjunction with a printer 10 and be located downstream of the printer. That is, the printer 10 forms an image on a substrate 20 and the substrate then passes to the present invention.

Through out this description the term "substrate" is used. However, it is understood that "substrate" includes any material on which an image may be created or transferred, including paper, paperboard, laminates, plastic fiber, plastic laminates, urethane, cloth, film, composites or fiberglass. Further, the , whether sheet fed, roll fed, or otherwise constructed. The substrate 20 has a given thickness for processing such as imaging. The substrate 20 may have any of a variety of widths and lengths depending upon the intended use and the imaging processing. That is, some imaging of the substrate 20 employs a continuous web, while other imaging processes on a sheet by sheet basis.

As shown in FIGS. 3–6, the substrate 20 has an imaging state 20' and a compressed state 20". In the imaging state 20' the substrate has a first thickness and in the compressed state 20" the substrate has a second lesser thickness. The substrate 20 may be transformed from the imaging state to the compressed state by the application of a compressive force. Preferably, the transformation of the substrate 20 from the imaging state 20' to the compressed state 20" is a one way process without secondary processing. That is, upon the substrate 20 being rendered to the compressed state 20", the substrate does not substantially migrate or creep back towards the thickness of the imaging state. The thickness in the compressed state 20" is between 30 percent to 95 percent of the thickness in the imaging state 20', with a desired thickness of less than 70 percent of the imaging thickness. However, it is understood the thickness in the compressed state may be 30 percent of less, than the thickness of the substrate in the imaging state.

Preferably, the substrate 20 has a threshold compression pressure sufficient to permit the desired imaging of the substrate without reducing its volume or transforming the substrate to the compressed state. That is, in the imaging state 20' the substrate has structural and performance characteristics and parameters sufficient to permit imaging through simplex or duplex operations including copiers, printers, facsimiles or the like. The structural characteristics of the substrate 20 in the imaging state are selected to permit the substrate to be used interchangeably with traditional substrates, such as paper.

Preferably, the substrate 20 can be compressed without changing the image. That is, the substrate 20 does not significantly distort, warp, or curl upon compression, and hence any image on the substrate is not degraded.

The substrate 20 may be formed of a variety of constructions such as a multiplicity of collapsible voids 21. The voids 21 may be formed by microstructures embedded in the substrate 20, as well as voids in the material of the substrate itself. The voids 21 may be formed by dispersing a multiplicity of micro capsules or spheres throughout the substrate 20 when the substrate is manufactured. Thus deformable embedded structures are located throughout the substrate 20. The deformable structures are selected such that upon application of the compressive force, the structures are sufficiently ruptured or collapsed to substantially preclude un aided return to the imaging configuration. Alternatively, the substrate 20 may include spacings sandwiched between layers. Other possible methods of constructing such substrates as laminates having a micro-thin layer of Styrofoam (or other highly compressible material) between two very thin layers of paper. The laminate has a sufficiently high tensile strength in the imaging state to permit use in imaging processes, yet yields to the compressive force to substantially reduce the thickness without distorting or degrading the image. A further construction of the substrate 20 contemplates the inclusion of a multiplicity of fibrous or puffy particles. Alternatively, the substrate 20 may include a corrugated layer that is irreversibly compacted upon exposure to the compressing force. However, any such compressible, collapsible paper will work well with this method.

The manufacture of such a paper substrate is known technology. specifically , U.S. Pat. No. 3,293,114 issued Dec. 20, 1966 discloses papers useful in packaging, printing, preparation of containers and the like wherein hollow expanded spherical particles are incorporated into the paper pulp by admixture with the wet pulp prior to deposition on the screen. These papers demonstrate increase stiffness and increase caliper.

U.S. Pat. No. 3,556,934 represents a method of making papers similar to that described in U.S. Pat. No. 3,293,114, mentioned above, with the exception that this patent teaches the incorporation of the microspheres in an unexpanded state to the aqueous suspension and during the drying of the paper subjecting it to temperatures sufficient to cause the particles to expand within the paper sheet.

U.S. Pat. No. 3,779,951 issued Dec. 18, 1973 relates to an improved method for the expansion of expandable microspheres in the presence of water.

U.S. Pat. No. 3,941,634 issued Mar. 2, 1976 discloses a method for the preparation of paper containing plastic particles by forming two-spaced apart dewatered webs of cellulose fibers introducing expandable thermoplastic beads between the dewatered webs pressing the spaced apart partially dewatered webs together and subjecting this product to heat to at least partially dry the fibers and at least expand a portion of the beads.

U.S. Pat. No. 4,133,688 issued Jan. 9, 1979 discloses a photographic paper coated with a polyolefin on both sides wherein in the preparation of the paper, either non-inflated microspheres which are subsequently inflated during the drying of the paper or inflated microspheres are added to the pulp during preparation of the paper.

U.S. Pat. No. 4,268,615 issued May 19, 1981 relates to a method of producing a relief by forming a layer of a pattern on the surface of a sheet made of a material having the property of increasing in volume when heated, the pattern being made of the material having a stronger ability to absorb light than the aforesaid material, and then radiating a strong light uniformly on the entire surface of the sheet to selectively heat the portion of the sheet adjacent the undersurface of the pattern layer whereby the pattern layer is raised from the sheet surface. The sheet is prepared by mixing microcapsules and a binder such as vinyl acetate polymers.

The image may be formed on the substrate 20 by any of a variety of mechanisms including, but not limited to xerographic transfer, ink jet, laser, facsimile, offset printing. It is understood the image may be formed on either, or both sides of the substrate 20.

The compressive force may be applied by ant of a variety of compressing mechanisms, including but not limited to rollers, calendaring, and presses. The compressive force acts to compress the substrate 20 so that the thickness of the substrate is reduced. In addition, it is believed under certain conditions that the compressive force urges the particles forming the image into the substrate 20. Thus, the image particles may not project as far from the substrate 20 in the compressed state as in the imaging state.

The entire surface of the substrate is exposed to the compressive force. The compressive force may be simultaneously applied to the entire surface area or sequentially applied to sections of the substrate 20 to encompass the entire area of the substrate.

In the roller configuration, a single roller may be employed to apply the pressure. Alternatively, a pair of opposing rollers 32, 34 may be used. The hardness and surface finish of the roller is at least partially determined by the anticipated processing volume, the substrate 20, the image and the desired finish to the substrate. The compressed substrates 20' may be compressed to exhibit a glossy, smooth, shiny, antiqued or matte finish. It is anticipated that at least some processing will seek to achieve a resulting finish that closely matches the imaged and uncompressed finish.

If rollers are used in the compressing process, fuser oil or toner residue may build up on these rollers. If so, a rubber squeegee, blade or knife may be used to remove or reduce accumulated oil or toner.

In the stacked substrate 20 configuration, a press plate acts over the surface area of the substrate. Although the press plate may have a variety of configurations for applying the compressive force such a piston, cam or a roller acting on a back of the press plate. A vacuum support plate may be used in cooperation with the press plate to assist in compressing those substrates having trapped or retained gases.

The sheet of collapsible paper is sent through a printer such as a copier or other imaging system. The page (substrate) is imaged on one or both sides. The page is then moved towards a compaction system 30 that may be connected to or integral with the imaging system 10 or it may be a separate element (FIG. 1). The compaction system then applies the compressive force to the major planes of the substrate (page). A simple manner of accomplishing compaction is to run the sheet of paper between two rollers or between a roller and a relatively hard surface. The substrate in the compressed state then moves to an output device or to be used.

The compressing mechanism 30 may be cooperatively engaged with current high speed printers having a bypass transport. The bypass transport distributes the printed sheets (substrates) 30 directly out of the printer into secondary processing equipment. Thus, the compressing mechanism 30 would be operably located as the secondary processing equipment.

Alternatively, the compressing mechanism 30 can be readily attached to the printer 10 and apply the necessary compressive force to reduce the paper thickness to the desired dimension as an intermediate step between the printer and subsequent secondary processing equipment.

Alternatively the pages of the substrate 20 can be loaded into a press that applies a predetermined amount of pressure on the pages resulting in compaction of the pages and the toner surface. The compressed pages may then be removed from the press. The loading and unloading may be done by hand, or it may be done through automated means. For example, in the case of a printer with a bypass transport, the press may be a simple bin where imaged pages are collected and then pressed before being extracted and sent on to the secondary processing equipment.

Thus, the compressing mechanism exerts the compressing force over the entire surface area of the substrate 20. In contrast to devices which may locally compact a section of a substrate, such as a seal, the present invention applies the compressive force over the entire area of the substrate 20.

In cooperation with the compressing mechanism 30, a heating mechanism 40 can be employed to assist in the reduction of the substrate thickness. The heating mechanism 40 may be any of a variety of configurations including radiant, convective or conductive heat. In one configuration, the compressing roller 32 or 34 may include a resistive heater such that the surface of the roller transfers heat tot he substrate being compressed. Alternatively, a separate heating roller may be employed upstream of the compressing roller. It is contemplated that radiative heaters, such as heat lamps, could be used to heat the substrate prior to exerting the compressive force. The substrate 20 may thus be heated above an ambient temperature, and if necessary to a higher temperature that is below a degradation temperature of the substrate.

Figure 3:
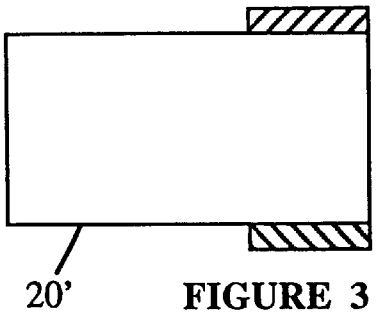
FIG. 3 is a cross sectional view of a substrate with an image forming material in an imaging state.
Figure 4:
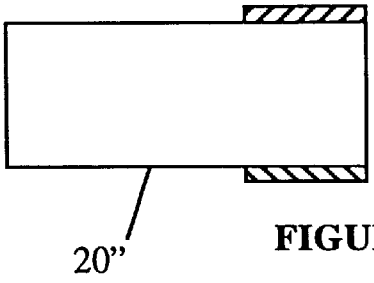
FIG. 4 is a cross sectional view of the substrate of FIG. 3 in a compressed state.

In a first example, as shown in FIGS. 3 and 4, a Xerox 4024 Bond paper was used as the substrate. The thickness of the substrate and image forming toner on two side of the substrate was 0.0044 inches. This substrate 20 has an imaging thickness of 0.004 inches. Upon the application of the compressing force between 400 to 1600 pound per linear inch, the substrate had a thickness of 0.0037 inches in the compressed state. The combined thickness of the substrate and the image forming toner on two sides of the substrate in the compressed state was 0.0041 inches. Thus, the resulting imaged substrate has a thickness of approximately 93 percent of original thickness paper. Thus, even substrates that do not include compressible or collapsible microstructures, can be compressed by over 5 percent.

Figure 5:
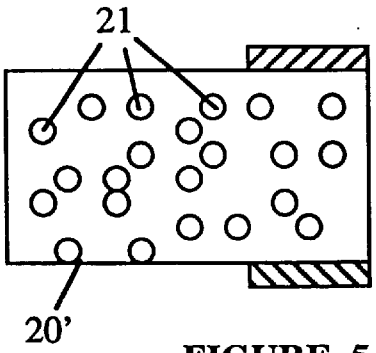
FIG. 5 is a cross sectional view of an alternative substrate with an image forming material in an imaging state.
Figure 6:
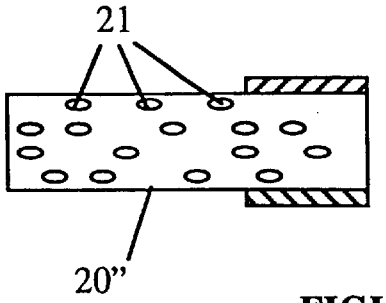
FIG. 6 is a cross sectional view of the substrate of FIG. 5 in a compressed state.

In a further example, as shown in FIGS. 5 and 6, the substrate 20 was formed with collapsible micro capsules. The imaged substrate in the imaged state had a thickness of 0.004 inches with a combined substrate and image forming toner on two sides of the substrate thickness of 0.0044 inches. After a compressive force of between 400 to 1600 pound per square inch, the substrate in the compressed state retained a thickness of 0.0026 inches with a with a combined substrate and image forming toner on two sides of the substrate thickness of 0.0028 inches. Thus, the substrate 20 in the compressed state had a thickness that was 65 percent of the original thickness. That is, the substrate 20 had been compressed by 35 percent.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A method for reducing a thickness of a compressible substrate bearing an image, the substrate having an initial thickness, comprising:

(a) applying a compressive force to the imaged substrate to compress the substrate to a compressed thickness less than the initial thickness, the compressive force selected to preclude the substrate returning to the initial thickness after removal of the compressive force from the substrate.

2. The method of claim 1, wherein the compressive force is applied by passing the substrate through a nip between a pair of rollers.

3. The method of claim 1, where the compressive force is between approximately 400 to 1600 pounds per square inch.

4. The method of claim 1, further comprising heating the substrate above ambient temperature prior to applying the compressive force.

5. The method of claim 1, wherein applying the compressive force is below a threshold force that degrades the image on the substrate.

6. A method for reducing a thickness of a substrate bearing an image, comprising:

(a) forming an image on a substrate, the substrate transformable from an imaging state having a first thickness to a compressed state having a second smaller thickness; and (b) compressing the imaged substrate to transform the substrate to the compressed state without substantially distorting the image.

7. A method for compacting an imaged substrate, comprising:

(a) forming an image on a plurality of sheets of a compressible substrate, the compressible substrate having an imaging thickness;

(b) applying a sufficient compressive force to a plurality of imaged sheets in a stack to compress each sheet to a compressed thickness less than the imaging thickness; and (c) removing the compressive force from the stack, so that the sheets remain at the compressed thickness.

8. An apparatus for forming an image on a compressed substrate, comprising:

(a) an image transfer station for transferring an image onto the substrate; and (b) a compressing station connected to the image transfer station to receive an imaged substrate and apply a sufficient compressive force to the imaged substrate to reduce a thickness of the substrate.

9. The method of claim 1, wherein the compressed thickness is less than or equal to 90% of the initial thickness.

10. A method for increasing the density of a substrate bearing an image, the substrate having an initial density, comprising:

(a) applying a compressive force to the imaged substrate to increase the density of the substrate, the compressive force selected to preclude the substrate returning to the initial density after removal of the compressive force from the substrate.

* * * * *